US011757201B2

(12) United States Patent
Wen et al.

(10) Patent No.: US 11,757,201 B2
(45) Date of Patent: Sep. 12, 2023

(54) MXENE-BASED TERAHERTZ WAVE BROADBAND SUPER- STRONG ABSORBING FOAM

(71) Applicant: University of Electronic Science and Technology of China, Sichuan (CN)

(72) Inventors: Qiye Wen, Chengdu (CN); Wenchao Shui, Chengdu (CN); Xu Xiao, Chengdu (CN); Yang Xing, Chengdu (CN); Qinghui Yang, Chengdu (CN); Huaiwu Zhang, Chengdu (CN); Jianmin Li, Chengdu (CN)

(73) Assignee: University of Electronic Science and Technology of China, Chengdu (CN)

( * ) Notice: Subject to any disclaimer, the term of this patent is extended or adjusted under 35 U.S.C. 154(b) by 227 days.

(21) Appl. No.: 17/349,837

(22) Filed: Jun. 16, 2021

(65) Prior Publication Data

US 2022/0045434 A1 Feb. 10, 2022

(30) Foreign Application Priority Data

Aug. 5, 2020 (CN) ..... 202010778633.0

(51) Int. Cl.
*H01Q 17/00* (2006.01)

(52) U.S. Cl.
CPC ..... *H01Q 17/00* (2013.01)

(58) Field of Classification Search
CPC .. H01Q 17/00; B01D 69/125; B01D 67/0069; B01D 71/02; B01D 71/14
USPC ..... 342/1
See application file for complete search history.

(56) References Cited

U.S. PATENT DOCUMENTS

2019/0344222 A1* 11/2019 Han ..... B01D 69/141
2020/0240000 A1* 7/2020 Gu ..... C23C 16/32
2021/0250693 A1* 8/2021 Spinelli ..... H04R 9/08

* cited by examiner

*Primary Examiner* — Bo Fan
(74) *Attorney, Agent, or Firm* — LeonardPatel PC; Sheetal S. Patel; Michael A. Leonard, II

(57) ABSTRACT

The present disclosure discloses an MXene-based terahertz wave broadband super-strong absorbing foam, and belongs to the technical field of electromagnetic functional materials. The MXene-based terahertz wave broadband super-strong absorbing foam includes a porous polymer foam and a MXene nanosheet attached onto the porous polymer foam, wherein the MXene nanosheet is attached onto the porous polymer foam in a coating form, a film forming form and a suspension form; the average pore diameter of the porous polymer foam ≥500 μm, the thickness of the porous polymer foam ≤10 mm, and the filling mass of the MXene nanosheet is less than 50% of the mass of the absorbing foam.

1 Claim, 7 Drawing Sheets

MXENE-BASED TERAHERTZ WAVE BROADBAND SUPER- STRONG ABSORBING FOAM

CROSS REFERENCE TO RELATED APPLICATION(S)

This patent application claims the benefit and priority of Chinese Patent Application No. 202010778633.0, filed on Aug. 5, 2020, the disclosure of which is incorporated by reference herein in its entirety as part of the present application.

TECHNICAL FIELD

The present disclosure belongs to the technical field of electromagnetic functional materials, relates to an electromagnetic wave absorbing structure, and in particular relates to a MXene-based terahertz wave broadband super-strong absorbing foam.

BACKGROUND ART

Terahertz (THz) waves refer to electromagnetic waves with frequencies ranging from 0.1 THz-10 THz and wavelengths between 3 mm-30 μm. Terahertz waves have many excellent properties, such as rich spectrum resources, low photon energy, good coherence, ultra-wide bands and the like, and show great application potential in radar detection, safety-inspection imaging, nondestructive testing, biosensing, the upcoming 6G communication, and the like aspects. With the rapid development of practical application of terahertz, the demand for high-performance terahertz wave absorbing materials is increasing day by day, and especially in radar detection, electromagnetic shielding, wireless communication, performance improvement of testing instruments, and the like aspects, terahertz wave absorbing materials with large bandwidth and high absorbing strength (>99%) are urgently needed. For example, the terahertz wave absorbing materials are needed at both transmitting and receiving ends of terahertz imaging and communication to greatly reduce sidelobe radiation or noise waves; and in a terahertz quasi-optical test system, the terahertz wave absorbing materials are also needed to reduce background noise and thus improve the test accuracy. More importantly, in the future radar detection technology, the terahertz wave absorbing materials can reduce the radar cross section (RCS), thereby imparting stealth properties to the terahertz system. Finally, the terahertz wave absorbing materials can also significantly reduce the electromagnetic radiation in the surrounding environment, and is also extremely important for improving the environmental quality and ensuring people's health. Therefore, the terahertz wave absorbing materials with broad bands, high absorbing efficiency and low cost have important practical significance for the development and application of terahertz technology.

Broadly speaking, electromagnetic wave absorbing materials are divided into resonant wave absorbing materials and broadband wave absorbing materials. Resonant wave absorbing materials mainly utilize specific artificial structures to achieve impedance matching with incident electromagnetic waves through resonance effects at a certain frequency point, so as to reduce electromagnetic wave reflection, and meanwhile a resistive layer or a reflective layer are utilized to reduce transmission, so as to achieve higher electromagnetic absorbing. In 2008, a terahertz absorber composed of an electromagnetic metamaterial disclosed in the literature "H.Tao et al., A metamaterial absorber for the terahertz regime: design, fabrication and characterization, Optics Express, 16:7181-7188, 2008" is a typical representative of resonant absorbing materials, and its absorbing intensity at the frequency point of 1.3 THz reaches 70%. In the terahertz wave band, most of condensed matters lack effective electromagnetic losses and responses to terahertz waves, so that the terahertz wave absorbing materials mainly adopt such a resonant artificial electromagnetic structure. However, resonant absorbing is essentially narrow-band absorbing, which is suitable for selective and tunable terahertz absorbing scenarios. Due to the extremely strong design flexibility of electromagnetic metamaterials, terahertz wave absorbing materials with multiple frequencies and certain bandwidths can also be realized through complex cell structure design, multi-cell combination, multi-layer stacking and the like technologies. However, this requires fine material design and complex micro-machining technologies. It is very difficult and costly to prepare it in large area, and it is also difficult to realize comprehensive properties of large bandwidth, high absorbing, large angle of absorbing, polarization insensitivity, compressibility and flexibility at the same time, which is not conducive to commercial popularization and application.

Another method to realize large-broadband electromagnetic wave absorbing materials is to adopt a porous structure. By utilizing the surface of the porous structure having electromagnetic parameters similar to those of air, the terahertz wave can directly enter the interior of the sample and in turn be depleted as absorbed by the interior conductive materials. There are two main difficulties of a broadband absorbing material based on the porous structure in improving the absorbing rate: (1) a problem of optimizing the porosity: larger porosity is beneficial to reduce the surface reflection, but it also means that the content of an absorbing ingredient in an unit volume of the material decreases, and even too large pore diameter will cause electromagnetic waves to directly penetrate the material and thus not be fully absorbed, however, at present, the pore diameters of most absorbing materials are generally below 100 microns, which cannot achieve an ideal anti-reflection effect; and (2) a problem of optimizing conductivity: in the terahertz wave band, the absorbing mainly comes from the electrical loss of conductive substances. However, it is very difficult to obtain electromagnetic wave absorbing materials with high conductivity, large absorbing area and strong absorbing effect on the premise of keeping high porosity and stability of the porous structure. In 2017, Professor Chen Yongsheng of Nankai University reported a terahertz wave absorbing material based on a three-dimensional graphene foam, wherein the three-dimensional conductive network obtained by reducing graphene oxide at high temperature achieves broadband absorption in the range of 0.2 THz-1.2 THz, with a reflection loss up to 19 dB and an effective bandwidth up to 95%. However, in order to improve the conductivity and terahertz absorbing effect of graphene, the material needs to be subjected to high-temperature annealing treatment at 1500° C., which not only increases the difficulty of preparation, but also makes the material very brittle and difficult to be applied in practical.

SUMMARY

An objective of the present disclosure is to provide a MXene-based terahertz wave broadband super-strong absorbing foam with a stable structure, large broadband and strong absorbing, aiming at the problems of low absorbing strength, poor mechanical stability, complex preparation process, high production cost and the like of the existing terahertz wave absorber in the background art. In the present disclosure, by utilizing the ultrahigh conductivity of the MXene two-dimensional nanosheet and the high dispersity of it in an aqueous solution, a three-dimensional network structure considering both large pore (pore per inch, ppi) diameter and large absorbing area is formed by compounding the MXene two-dimensional nanosheet with a surface functionalized porous polymer foam, so that the ultrahigh absorbing rate up to more than 99.99% and the extremely low reflectivity as low as 0.00003% within the range of 0.3-1.65 THz are realized. The absorbing material has the excellent properties of a stable structure, good compressibility, strong flexibility, ultra-light weight and thinness, and meanwhile also has many advantages such as low preparation cost, simple process and being capable of preparing in large area, which shows an outstanding practical application value.

In order to achieve the aforementioned objective, the technical solution adopted by the present disclosure is as follows.

A MXene-based terahertz wave broadband super-strong absorbing foam is characterized by including a porous polymer foam and a MXene nanosheet attached onto the porous polymer foam, wherein the MXene nanosheet is attached onto the porous polymer foam in three main forms of a coating form, a film forming form and a suspension form; the average pore diameter of the porous polymer foam ≥500 μm, the thickness of the porous polymer foam ≤10 mm, and the filling mass of the MXene nanosheet is less than 50% of the mass of the absorbing foam.

Furthermore, by adjusting the filling mass fraction (≤50%) of the MXene nanosheet in the absorbing foam and the pore diameter (300 μm-3 mm) of the porous polymer foam, the relative proportions of the three main forms (coating, film forming and suspension) of the MXene nanosheet can be controlled. Among them, the coating form is the basic form and always belongs to the form with the largest proportion; the MXene nanosheet with the filling mass fraction of 10%-50% and the polymer foam with the pore diameter of 300 μm-650 μm are easier to form the film forming form; and the MXene nanosheet with the filling mass fraction of 10%-50% and the polymer foam with the pore diameter of 650 μm-1 mm are easier to form the suspension form. In the frequency range of 0.3-1.65 THz, by adjusting the relative proportions of the three main forms (coating, film forming and suspension) of the MXene nanosheet, the sample with the coating form and suspension form as main forms has the terahertz wave absorbing rate up to more than 99.99%, and the terahertz wave reflectivity as low as 0.00003%. 1101 Further, the porous polymer foam has a porous structure with a non-single pore diameter size, the pore diameter ranges from 300 μm-3 mm, and the average pore diameter ≥500 μm.

Further, the porous polymer foam has a density of 0.02-0.056 g $cm^{-3}$, a very light weight, and the porosity ≥85%.

Further, the porous polymer foam includes but is not limited to a polyurethane sponge foam, a polyimide foam, a polypropylene foam, and the like.

Furthermore, the MXene (translated as MXene alkene in Chinese) is a kind of two-dimensional transition metal carbides, nitrides or carbonitrides, and the MXene nanosheet is obtained by etching and peeling its precursor MAX phase. MXene materials include but are not limited to $Ti_3C_2T_x$, $Nb_2CT_x$, $Mo_2TiC_2T_x$, $Nb_4C_3T_x$, $Mo_2Ti_2C_3T_x$, $V_2CT_x$, $Ti_2CT_x$, $Ti_3CNT_x$, etc., wherein $T_x$ represents surface functional groups, such as —OH, —F, —O, etc.

Further, the MXene nanosheet has a monolithic transverse length of 0.05-30 μm, a thickness of 3-20 nm, and a conductivity ≥5,000 S $cm^{-1}$.

A method for preparing a MXene-based terahertz wave broadband super-strong absorbing foam, is provided, which includes the steps of:

step 1. formulating an acidic aqueous solution containing fluorine ions, etching off a layer A in a precursor MAX by using the acidic aqueous solution, and then repeatedly centrifuging and washing to obtain a multilayer MXene mixed solution;

step 2. adding an intercalation agent into the multilayer MXene mixed solution obtained in step 1, mixing uniformly under stirring, and centrifuging and washing for many times to obtain a MXene suspension;

step 3. soaking a porous polymer foam with a pore diameter of 300 μm-3 mm and a thickness ≤10 mm in the MXene suspension obtained in step 2 for a soaking time of 5-30 min, wherein in the soaking process the porous polymer foam is squeezed by tweezers for several times (more than 3 times); and after completion of soaking, taking the porous polymer foam out and allowing it to stand for more than 30 min under conditions of normal temperature and normal pressure until no MXene solution drips from the surface of the sample; and step 4. placing the sample obtained in step 3 into a vacuum drying oven, and drying at 30-80° C. for 12-36 h to obtain the MXene-based terahertz wave broadband super-strong absorbing foam.

Further, the process of preparing the MXene suspension in step 1 and step 2 specifically includes:

(1) uniformly mixing hydrochloric acid, hydrofluoric acid and deionized water to obtain an etching solution; wherein the volume ratio of hydrochloric acid, hydrofluoric acid and deionized water is 4:1:2;

(2) adding $Ti_3AlC_2$ powder into the etching solution obtained in the step (1), stirring at room temperature for 12-36 h, and etching off a Al layer in the MAX phase of $Ti_3AlC_2$ to obtain an acidic solution of $Ti_3C_2T_x$ MXene; wherein 0.03-0.06 g of the $Ti_3AlC_2$ powder is added per 1 mL of the etching solution;

(3) repeatedly centrifuging and washing the acidic solution of $Ti_3C_2T_x$ MXene obtained in the step (2) with deionized water for many times until the pH value of the supernatant is 5-7, so as to obtain a multilayer $Ti_3C_2T_x$ MXene precipitate;

(4) dispersing the multilayer $Ti_3C_2T_x$ MXene precipitate obtained in the step (3) into a LiCl solution, stirring for 1-4 h, and repeatedly centrifuging and washing with deionized water for many times until the supernatant becomes black; wherein the concentration of the LiCl solution is 0.000024-0.0007 mol/mL, and every 1 g of $Ti_3AlC_2$ powder in the step (2) corresponds to 50-150 mL of the LiCl solution; and (5) dispersing the precipitate obtained in the step (4) in deionized water to obtain an uniformly dispersed $Ti_3C_2T_x$ suspension; wherein the mass concentration of $Ti_3C_2T_x$ in the $Ti_3C_2T_x$ suspension is 0.1 mol/mL-15 mol/mL.

The working principle of the present disclosure is as follows:

For the absorbing material, it is necessary to minimize surface reflection and improve internal electromagnetic wave loss. (1) when the terahertz waves are incident on the surface of the terahertz absorbing foam, the terahertz waves directly enter the interior of the foam almost without reflection since the electromagnetic parameters of the foam are approximately equal to those of air due to the macroporous structure of the foam itself (the size of the pore diameter is 300 μm-3 mm, the average pore diameter ≥500 μm); (2) in the interior of the absorbing foam, due to the existence of different pore diameters, the MXene nanosheet spontaneously form three different forms (coating form, film forming form and suspension form) on the skeleton network of the foam, these three different forms of the MXene nanosheet provide a large amount of reflection and scattering of the incident terahertz waves, which greatly increases the transmission path of the terahertz waves in the absorbing material; and meanwhile, the MXene nano-films in the film forming form and the suspension form greatly increase the absorbing area of the material. More importantly, due to the extremely high conductivity of the MXene nanosheet (the conductivity can reach more than 5,000 S $cm^{-1}$), the electrical loss of the terahertz waves is very large, so a strong absorbing of the terahertz waves are generated in the interior of the foam. The MXene-based terahertz wave broadband super-strong absorbing foam provided by the present disclosure has the advantages that the absorbing rate of it is up to more than 99.99% and the reflectivity of it is as low as 0.00003% due to the ultra-high conductivity of the MXene nanosheet, the larger pore diameter (300 μm-3 mm) of the porous polymer foam itself and the three main conductive network forms (coating, film forming and suspension) spontaneously formed by the MXene nanosheet and the porous foam, which greatly improves the absorption of the terahertz waves by the macroporous foam sample and effectively reduces the reflection; the specific absorbing process is as shown in FIGS. 1: (1), (4) and (6) represent terahertz waves incident on the surface of the absorbing material, and (2), (3), (5), (7) and (8) represent propagation paths of the terahertz waves in the interior of the absorbing material. When the terahertz wave (1) is vertically incident on the MXene foam, some energy is absorbed by charge carriers (electrons or holes) inside the MXene nanosheet (in the coating form) attached to the skeleton of the porous polymer foam, and after the reflected terahertz wave (2) is incident on the MXene thin film (in the film forming form) formed by the nanosheet, some energy is further absorbed by the charge carriers, while the remaining reflected terahertz wave (3) continues to propagate in the interior of the foam until finally it is completely absorbed by the MXene nanosheet (in the coating form) coated on the skeleton; when the terahertz wave (4) is incident on the nanosheet (in the suspension form) suspended on the skeleton through a long propagation path, some energy is absorbed by charge carriers, while the energy of the reflected terahertz wave (5) is completely absorbed by the MXene thin film (in the coating form) coated on the skeleton finally; when the terahertz wave (6) is vertically incident on the suspended MXene thin film (in the suspension form), a very small part as the terahertz wave (7) is reflected and depleted as absorbed by the MXene nanosheet (in the coating form) coated on the skeleton, while another part as the terahertz wave (8) that is transmitted/refracted from the suspended MXene thin film, is also completely absorbed by other MXene thin films (in the coating form) finally after propagating for a certain distance.

It can be seen from the aforementioned principle that, in the present disclosure, the larger porous structure (with the size of the pore diameter of 300 μm-3 mm) of the porous polymer foam, the high conductivity of the MXene nanosheet, the high dispersion of nanosheets in the porous structure, and the three main conductive network forms (coating, film forming and suspension) spontaneously formed by the MXene nanosheet and the porous foam are important factors that affect the absorbing efficiency of the terahertz waves.

Compared with other existing terahertz wave absorbing materials, the present disclosure has the following advantages:

1. the MXene-based terahertz wave broadband super-strong absorbing foam provided by the present disclosure has the properties of broadband strong absorbing and low reflection, the terahertz wave absorbing rate up to more than 99.99% and the terahertz wave reflectivity as low as 0.00003% in the test frequency range of 0.3-1.65 THz;

2. the MXene-based terahertz wave broadband super-strong absorbing foam provided by the present disclosure has excellent mechanical properties and can be stretched, bent, twisted and compressed at any angle; and has good hydrophobic characteristics with a hydrophobic angle up to 120±2°, which provides feasibility for its application in a harsh environment;

3. the MXene-based terahertz wave broadband super-strong absorbing foam provided by the present disclosure has an extremely light weight, and an adjustable density in the range of 0.02-0.056 g $cm^{-3}$, and the filling mass fraction of the MXene nanosheet ≤50%;

4. the MXene-based terahertz wave broadband super-strong absorbing foam provided by the present disclosure has the terahertz wave absorbing rate that can be adjusted by changing the load (with the filling mass fraction ≤50%) of the MXene nanosheet and the relative contents of its three distribution forms (coating, film forming and suspension); and 5. compared with the existing terahertz wave absorbers based on metamaterials and graphene foams, the MXene-based terahertz wave broadband super-strong absorbing foam provided by the present disclosure has the advantages of a simple preparation process, low cost, easy realization and the like; it can also be made into large-size devices compatible with CMOS, and thus is suitable for large-scale industrial production and application.

DETAILED DESCRIPTION OF THE EMBODIMENTS

Figure 1:
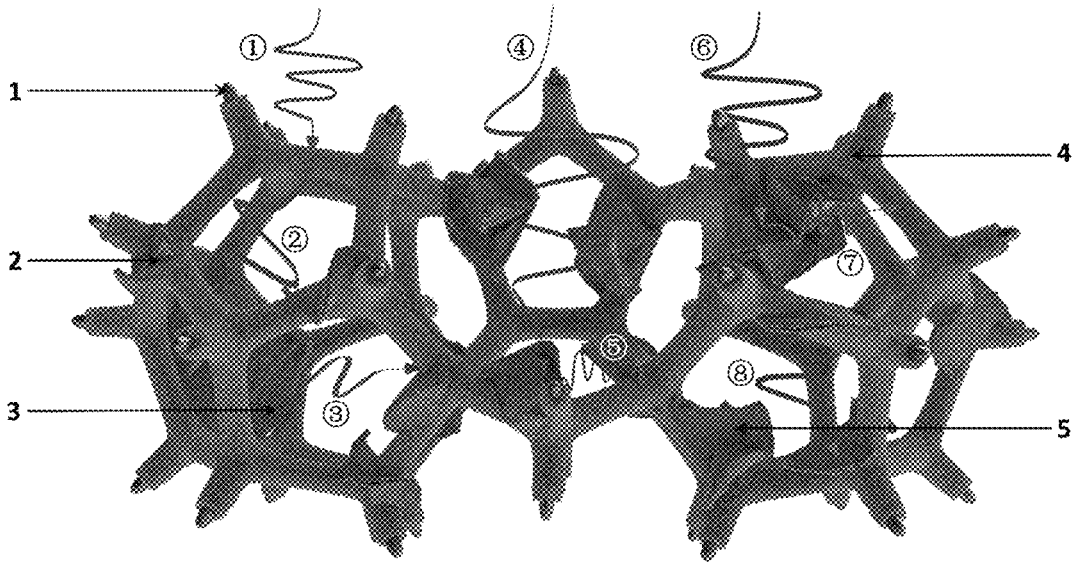
FIG. 1 is a schematic diagram of the principle that terahertz waves are vertically incident on the MXene-based terahertz wave broadband super-strong absorbing foam of the present disclosure; wherein 1 represents the skeleton of the porous foam, 2 represents the MXene nanosheet, 3 represents the MXene film formed spontaneously by combining the MXene nanosheet with the skeleton of the foam, 4 represents the MXene nanosheet coated on the skeleton of the foam, and 5 represents the MXene nanosheet suspended on the skeleton of the foam; and (1), (2), (3), (4), (5), (6), (7) and (8) represent the propagation paths of terahertz waves in the interior of the absorbing foam.
Figure 2:
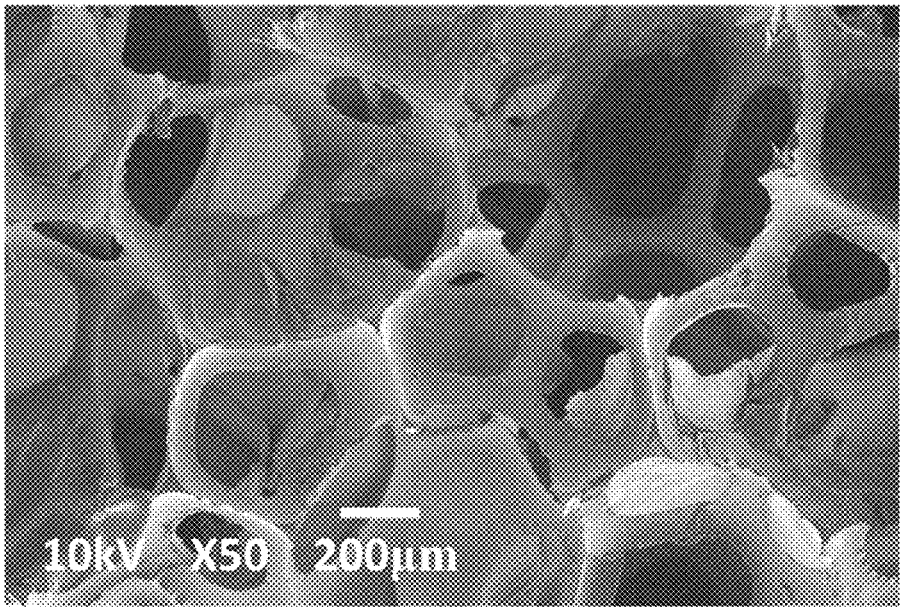
FIG. 2 is a scanning electron microscope (SEM) graph of the terahertz wave broadband super-strong absorbing foam with the size of pore diameter of 50 ppi (about 650 μm), a thickness of 2 mm, and an MXene nanosheet filling amount of 2.8±0.5 mg, as obtained in Example 1 of the present disclosure.

The present disclosure will be further described in detail with reference to the accompanying drawings and examples, and the present disclosure is not limited to these examples.

Example 1

The method for preparing MXene-based terahertz wave broadband super-strong absorbing foams with different pore diameters as provided by this example includes the steps of:

step 1. uniformly mixing hydrochloric acid, hydrofluoric acid and deionized water to obtain 63 mL of an etching solution, wherein the volume ratio of hydrochloric acid, hydrofluoric acid and deionized water is 4:1:2; then, slowly adding 3 g of $Ti_3AlC_2$ powder into the etching solution and stirring at room temperature for 24 h to selectively etch off the Al layer in the $Ti_3AlC_2$ MAX phase, so as to obtain a $Ti_3C_2T_x$ MXene acidic solution;

step 2. adding deionized water into the $Ti_3C_2T_x$ MXene acidic solution obtained in step 1, centrifuging and washing for many times until the pH value of the supernatant is 6, and filtering and separating to obtain a multilayer $Ti_3C_2T_x$ MXene precipitate; then, dispersing the obtained multilayer $Ti_3C_2T_x$ MXene precipitate in 180 mL of a LiCl solution, stirring for 1 h, and repeatedly centrifuging and washing with deionized water for many times until the supernatant became black; wherein the concentration of the LiCl solution is 0.0004 mol/mL;

step 3. dispersing the precipitate obtained in step 2 in deionized water to obtain an uniformly dispersed $Ti_3C_2T_x$ suspension; wherein the mass concentration of $Ti_3C_2T_x$ in the $Ti_3C_2T_x$ suspension is 2 mg/mL;

step 4. soaking polyurethane sponge foams with the same thickness (2 mm) and different pore diameters in the $Ti_3C_2T_x$ suspension obtained in step 3 for 25 min, wherein in the soaking process the porous polymer foam is squeezed by tweezers for several times (more than 3 times); and after completion of soaking, taking the porous polymer foam out and allowing it to stand for more than 30 min under conditions of normal temperature and normal pressure until no MXene solution drips from the surface of the sample; wherein the pore diameter of the polyurethane sponge foam is 35 ppi (with the size of pore diameter of about 1500 μm), 50 ppi (with the size of pore diameter of about 650 μm) and 60 ppi (with the size of pore diameter of about 300 μm); and step 5. placing the sample obtained in step 4 into a vacuum drying oven, and drying at 60° C. for 12 h to obtain the MXene-based terahertz wave broadband super-strong absorbing foam.

Example 2

The method for preparing terahertz wave broadband super-strong absorbing foams with different MXene filling masses as provided by this example includes the steps of:

step 1. uniformly mixing hydrochloric acid, hydrofluoric acid and deionized water to obtain 63 mL of an etching solution, wherein the volume ratio of hydrochloric acid, hydrofluoric acid and deionized water is 4:1:2; then, slowly adding 3 g of $Ti_3AlC_2$ powder into the etching solution and stirring at room temperature for 24 h to selectively etch off the Al layer in the $Ti_3AlC_2$ MAX phase, so as to obtain a $Ti_3C_2T_x$ MXene acidic solution;

step 2. adding deionized water into the $Ti_3C_2T_x$ MXene acidic solution obtained in step 1, centrifuging and washing for many times until the pH value of the supernatant is 6, and filtering and separating to obtain a multilayer $Ti_3C_2T_x$ MXene precipitate; then, dispersing the obtained multilayer $Ti_3C_2T_x$ MXene precipitate in 180 mL of a LiCl solution, stirring for 1 h, and repeatedly centrifuging and washing with deionized water for many times until the supernatant became black; wherein the concentration of the LiCl solution is 0.0004 mol/mL;

step 3. dispersing the precipitate obtained in step 2 obtain in deionized water to obtain an uniformly dispersed $Ti_3C_2T_x$ suspension;

step 4. soaking polyurethane sponge foams with the same thickness (2 mm) and the same pore diameter (50 ppi) in $Ti_3C_2T_x$ suspensions with different mass concentrations (with the mass concentrations of 8 mg/mL, 4 mg/mL, 1.8 mg/mL, 1.4 mg/mL, 0.8 mg/mL, 0.3 mg/mL and 0.1 mg/mL, respectively) for 30 min, wherein in the soaking process the porous polymer foam is squeezed by tweezers for several times (more than 3 times); and after completion of soaking, taking the porous polymer foam out and allowing it to stand for more than 30 min under conditions of normal temperature and normal pressure until no MXene solution drips from the surface of the sample;

step 5. drying the sample obtained in step 4 in a vacuum drying oven under the condition of 60° C. for 12 h, so as to make and form the MXene-based terahertz wave broadband super-strong absorbing foam.

Example 3

The method for preparing MXene-based terahertz wave broadband super-strong absorbing foams with different thicknesses as provided by this example includes the steps of:

step 1. uniformly mixing hydrochloric acid, hydrofluoric acid and deionized water to obtain 63 mL of an etching solution, wherein the volume ratio of hydrochloric acid, hydrofluoric acid and deionized water is 4:1:2; then, slowly adding 3 g of $Ti_3AlC_2$ powder into the etching solution and stirring at room temperature for 24 h to selectively etch off the Al layer in the $Ti_3AlC_2$ MAX phase, so as to obtain a $Ti_3C_2T_x$ MXene acidic solution;

step 2. adding deionized water into the $Ti_3C_2T_x$ MXene acidic solution obtained in step 1, centrifuging and washing for many times until the pH value of the supernatant is 6, and filtering and separating to obtain a multilayer $Ti_3C_2T_x$ MXene precipitate; then, dispersing the obtained multilayer $Ti_3C_2T_x$ MXene precipitate in 180 mL of a LiCl solution, stirring for 1 h, and repeatedly centrifuging and washing with deionized water for many times until the supernatant became black; wherein the concentration of the LiCl solution is 0.0004 mol/mL;

step 3. dispersing the precipitate obtained in step 2 in deionized water to obtain an uniformly dispersed $Ti_3C_2T_x$ suspension; wherein the mass concentration of $Ti_3C_2T_x$ in the $Ti_3C_2T_x$ suspension is 2 mg/mL;

step 4. soaking polyurethane sponge foams with the same pore diameter (50 ppi) and different thicknesses (2 mm, 4 mm, 10 mm) in the $Ti_3C_2T_x$ suspension obtained in step 3 for 30 min, wherein in the soaking process the porous polymer foam is squeezed by tweezers for several times (more than 3 times); and after completion of soaking, taking the porous polymer foam out and allowing it to stand for more than 30 min under conditions of normal temperature and normal pressure until no MXene solution drips from the surface of the sample;

step 5. placing the sample obtained in step 4 into a vacuum drying oven, and drying at 60° C. for 12 h to obtain the MXene-based terahertz wave broadband super-strong absorbing foam.

Figure 3:
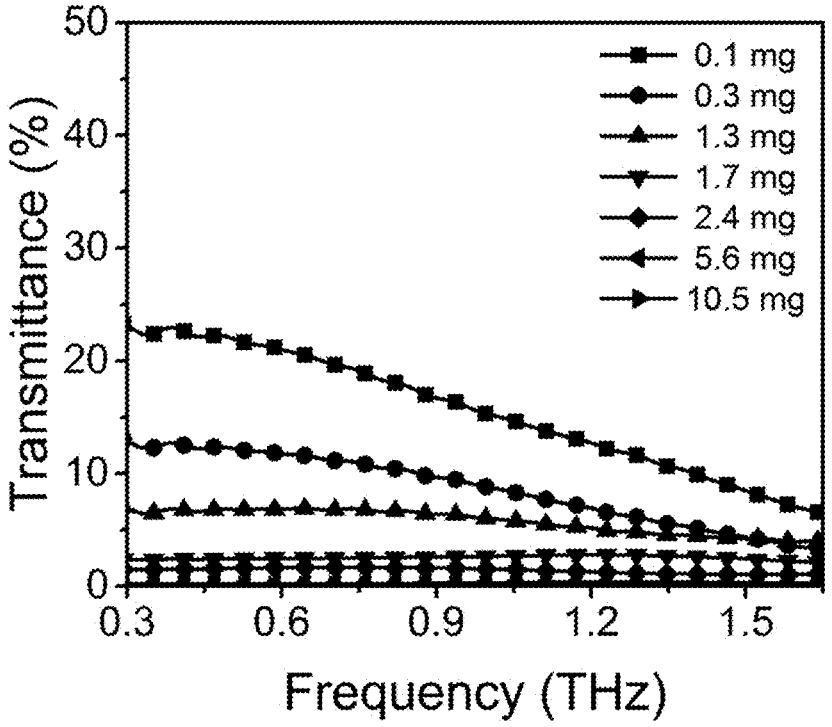
FIG. 3 shows the transmission spectrum of the terahertz wave broadband super-strong absorbing foams with different MXene nanosheet filling amount, a thickness of 2 mm and a pore diameter of 50 ppi, as obtained in Example 2 of the present disclosure, in the range of 0.3 THz to 1.65 THz.

FIG. 3 shows the transmission spectrum of the terahertz wave broadband super-strong absorbing foams with different MXene nanosheet filling amount, a thickness of 2 mm and a pore diameter of 50 ppi, as obtained in Example 2 of the present disclosure, in the range of 0.3 THz to 1.65 THz; and it can be seen from the figure that with the increase of the MXene nanosheet filling amount, the terahertz wave transmittance of the absorbing foam gradually decreases, and can reach the lowest of about 0.008% (with the nanosheet filling amount of 10.5 mg), which indicates that the MXene nanosheet filling amount has an important influence on the transmission of terahertz waves.

Figure 4:
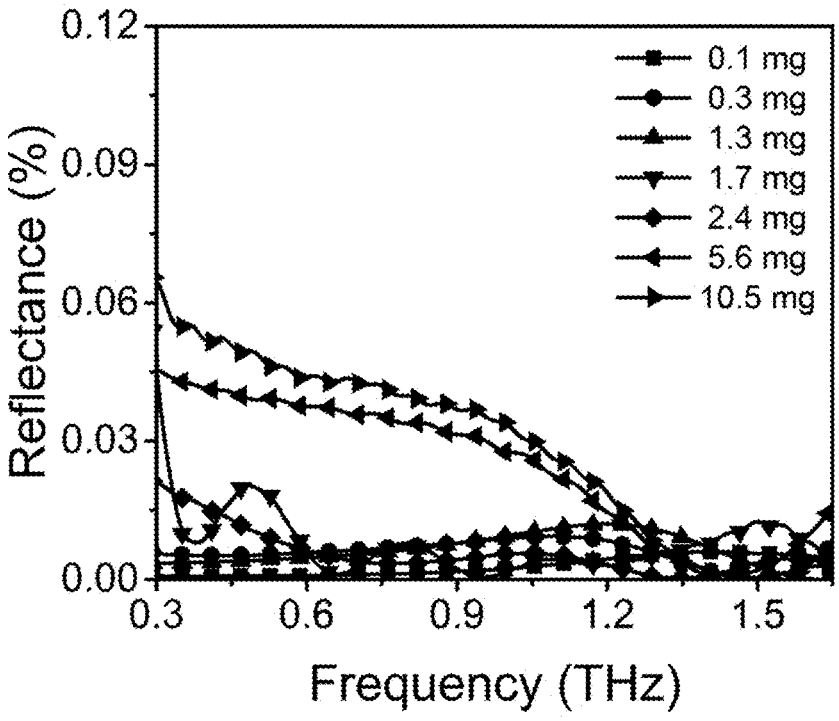
FIG. 4 shows the reflection spectrum of the terahertz wave broadband super-strong absorbing foams with different MXene nanosheet filling amount, a thickness of 2 mm and a pore diameter of 50 ppi, as obtained in Example 2 of the present disclosure, in the range of 0.3 THz to 1.65 THz.

FIG. 4 shows the reflection spectrum of the terahertz wave broadband super-strong absorbing foams with different MXene nanosheet filling amount, a thickness of 2 mm and a pore diameter of 50 ppi, as obtained in Example 2 of the present disclosure, in the range of 0.3 THz to 1.65 THz. It can be seen from the figure that with the increase of the MXene nanosheet filling amount, the terahertz wave reflectivity of the foam sample is always kept in a very low range (<0.07%) due to the macroporous characteristic of the foam sample itself. However, when the nanosheet filling amount reaches 10.5 mg, the reflectivity increases slightly due to the high conductivity of the MXene nanosheet itself, but it is always lower than 0.07%. This indicates that the MXene nanosheet filling amount has little effect on reflection of terahertz waves, which successfully solves the problem of high reflectivity caused by the high conductivity of the porous foam.

Figure 5:
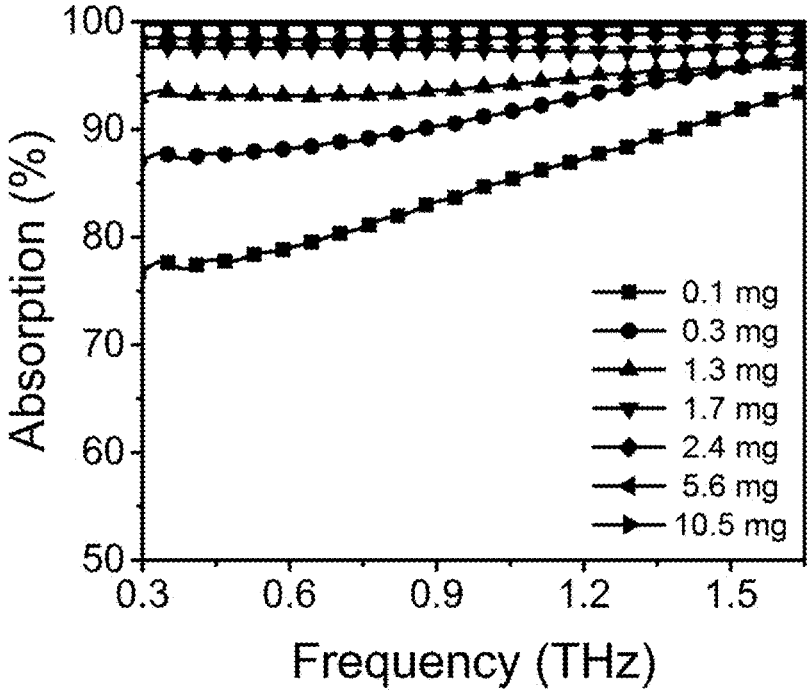
FIG. 5 shows the absorption spectrum of the terahertz wave broadband super-strong absorbing foams with different MXene nanosheet filling amount, a thickness of 2 mm and a pore diameter of 50 ppi, as obtained in Example 2 of the present disclosure, in the range of 0.3 THz to 1.65 THz.
Figure 6:
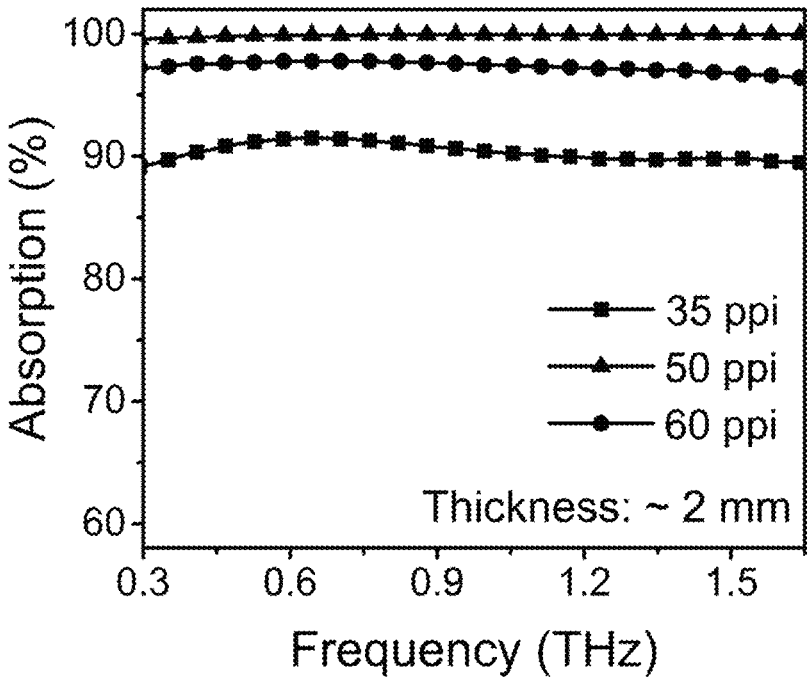
FIG. 6 shows the absorption spectrum of the terahertz wave broadband super-strong absorbing foams with different pore diameters, a thickness of 2 mm and the MXene nanosheet filling amount of 2.8±0.5 mg, as obtained in Example 1 of the present disclosure, in the range of 0.3 THz to 1.65 THz.

FIG. 5 shows the absorption spectrum of the terahertz wave broadband super-strong absorbing foams with different MXene nanosheet filling amount, a thickness of 2 mm and a pore diameter of 50 ppi, as obtained in Example 2 of the present disclosure, in the range of 0.3 THz to 1.65 THz; according to the transmissivity shown in FIG. 3 and the reflectivity shown in FIG. 4, the absorptivity of different samples A=1−R−T, thereby obtaining the absorption spectrum as shown in FIG. 5. It can be seen from the figure that with the increase of the MXene nanosheet filling amount, the terahertz wave absorbing rate of the foam gradually increases, and can reach the highest of approximately more than 99.99% (with the nanosheet filling amount of 10.5 mg), which strongly proves that the MXene absorbing foam has super-strong effect of absorbing terahertz waves. [67] FIG. 6 shows the absorption spectrum of the terahertz wave broadband super-strong absorbing foams with different pore diameters, a thickness of 2 mm and the MXene nanosheet filling amount of 2.8±0.5 mg, as obtained in Example 1 of the present disclosure, in the range of 0.3 THz to 1.65 THz; it can be seen from the figure that under the condition of the foam thickness of 2 mm, the MXene foam with the pore diameter of 50 ppi has a higher terahertz wave absorbing rate than the foams with the pore diameters of 35 ppi and 60 ppi, which indicates that the foam with the pore diameter of 50 ppi is the one with the best terahertz wave absorbing effect among the three foams with different pore diameters, and the three samples with different pore diameters have extremely strong absorption of the terahertz waves (with the absorbing rate ≥90%).

Figure 7:
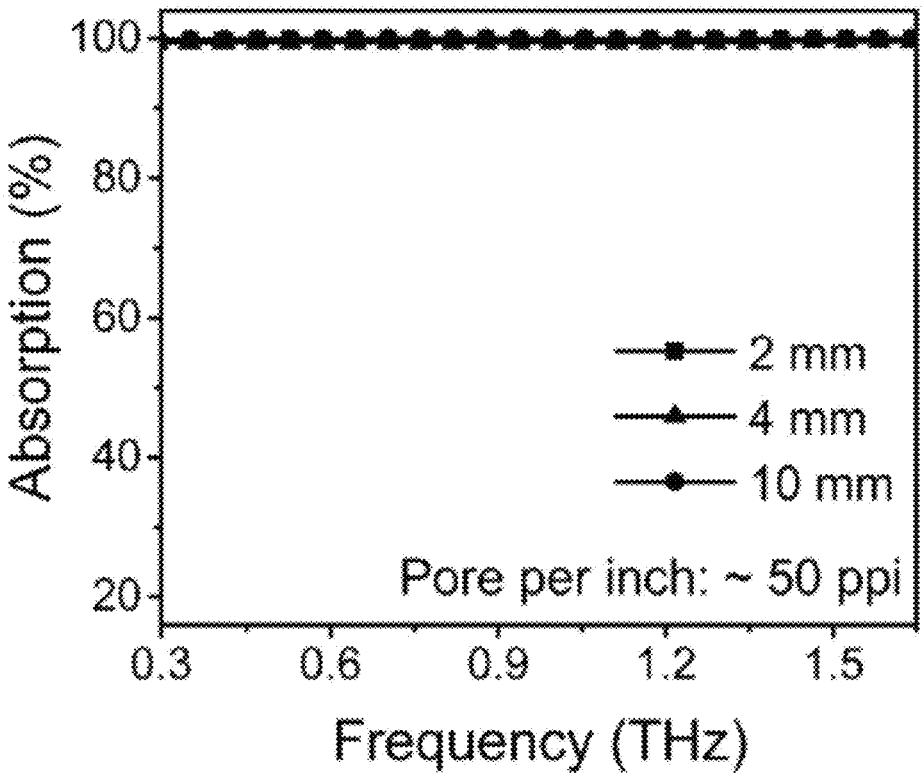
FIG. 7 shows the absorption spectrum of terahertz wave broadband super-strong absorbing foams with different thicknesses, a pore diameter of 50 ppi and the MXene nanosheet filling amount of 2.8±0.5 mg, as obtained in Example 3 of the present disclosure, in the range of 0.3 THz to 1.65 THz.

FIG. 7 shows the absorption spectrum of terahertz wave broadband super-strong absorbing foams with different thicknesses, a pore diameter of 50 ppi and the MXene nanosheet filling amount of 2.8±0.5 mg, as obtained in Example 3 of the present disclosure, in the range of 0.3 THz to 1.65 THz. It can be seen from the figure that under the condition of the pore diameter of 50 ppi, the terahertz wave absorbing rates of the absorbing foams with thicknesses of 2 mm, 4 mm and 10 mm are almost the same, all of which are greater than 99%, and the absorbing rate of the foam with the thickness of 2 mm can reach 99.99%, which indicates that the thickness has little effect on the absorption of terahertz waves under the condition of the pore diameter of 50 ppi.

In view of the above, the MXene terahertz wave broadband super-strong absorbing foams with different thicknesses and different pore diameters (300 μm-3 mm) as prepared in the examples all have excellent terahertz wave absorbing characteristics in the range of 0.3 THz-1.65 THz, wherein the sample with the thickness of 2 mm and the pore diameter of 50 ppi has the terahertz wave absorbing rate up to more than 99.99%, and the terahertz wave reflectivity as low as 0.00003%, and is a terahertz wave macroporous absorbing foam with super-strong absorption and extremely low reflection.

The invention claimed is:

1. A method for preparing a MXene-based terahertz wave broadband super-strong absorbing foam, comprising the steps of:

step 1. formulating a MXene suspension;

step 2. soaking a porous polymer foam with a pore diameter of 300 μm-3 mm and a thickness ≤10 mm in the MXene suspension obtained in step 1 for a soaking time of 5-30 min, wherein in the soaking process the porous polymer foam is squeezed by tweezers for several times; and after completion of soaking, taking the porous polymer foam out and allowing it to stand for more than 30 min at normal temperature and normal pressure; and step 3. placing the sample obtained in step 2 into a vacuum drying oven, and drying at 30-80° C. for 12-36 h to obtain the MXene-based terahertz wave broadband super-strong absorbing foam;

wherein the MXene suspension in step 1 is prepared by a process comprising:

(1) uniformly mixing hydrochloric acid, hydrofluoric acid and deionized water to obtain an etching solution; wherein the volume ratio of hydrochloric acid, hydrofluoric acid and deionized water is 4:1:2;

(2) adding $Ti_3AlC_2$ powder into the etching solution obtained in the step (1) stirring at room temperature for 12-36 h and etching off a Al layer in the MAX phase of $Ti_3AlC_2$ to obtain an acidic solution of $Ti_3C_2T_x$MXene; wherein 0.03-0.06 g of the $Ti_3AlC_2$ powder is added per 1 mL of the etching solution;

(3) repeatedly centrifuging and washing the acidic solution of $Ti_3C_2T_x$ MXene obtained in the step (2) with deionized water for many times until the pH value of the supernatant is 5-7, so as to obtain a multilayer $Ti_3C_2T_x$ MXene precipitate;

(4) dispersing the multilayer $Ti_3C_2T_x$ MXene precipitate obtained in the step ( 3) into a LiCl solution, stirring for 1-4 h, and repeatedly centrifuging and washing with deionized water for many times until the supernatant becomes black; wherein the concentration of the LiCl solution is 0.000024-0.0007 mol/mL, and every 1 g of $Ti_3AlC_2$ powder in the step (2) corresponds to 50-150 mL of the LiCl solution; and (5) dispersing the precipitate obtained in the step (4) in deionized water to obtain an uniformly dispersed $Ti_3C_2T_x$ suspension; wherein the mass concentration of $Ti_3C_2T_x$ in the $Ti_3C_2T_x$ suspension is 0.1 mol/mL-15 mol/mL.

* * * * *